United States Patent [19]

Pizzi

[11] 4,387,650

[45] Jun. 14, 1983

[54] STORABLE TABLE

[76] Inventor: Domenico Pizzi, 18 Kashey St., Clifton, N.J. 07013

[21] Appl. No.: 231,650

[22] Filed: Feb. 5, 1981

[51] Int. Cl.[3] ..... A47B 3/00

[52] U.S. Cl. ..... 108/40; 108/6; 108/39; 108/93; 248/291; 312/282; 312/348

[58] Field of Search ..... 108/39, 40, 6, 93, 94; 312/282, 281, 348, 333; 248/290, 291, 289.1, 294, 240.4, 284, 278, 316 A

[56] References Cited

U.S. PATENT DOCUMENTS

| | | | |
|---|---|---|---|
| 2,331,576 | 10/1943 | Siskin | 108/40 X |
| 2,605,155 | 7/1952 | Lewis | 108/6 |
| 2,609,938 | 9/1952 | Wells | 108/64 X |
| 2,712,484 | 7/1955 | Adolphson | 108/40 X |
| 3,746,418 | 7/1973 | Barber, Jr. | 312/348 |
| 3,917,369 | 11/1975 | Sevec et al. | 312/333 |
| 3,980,265 | 9/1976 | Pizzi | 312/281 X |
| 4,196,821 | 4/1980 | Teti, Jr. et al. | 248/291 X |

FOREIGN PATENT DOCUMENTS

| | | | |
|---|---|---|---|
| 216378 | 12/1941 | Switzerland | 108/93 |
| 389792 | 6/1931 | United Kingdom | 248/316 A |

*Primary Examiner*—James T. McCall

*Attorney, Agent, or Firm*—Robert D. Farkas

[57] ABSTRACT

A storable table utilizes a sliding T-shaped block member disposed within an elongated T-shaped passageway located within an elongated supporting member. The supporting member is secured to a supporting structure so as to have its passageway disposed in a horizontal position. An L-shaped bracket has one leg secured to the block slideably engaged within the passageway. The other end of the L-shaped block is fitted with a plurality of pin receiving receptacles, disposed outwardly from a shaft secured in the lowermost regions, adjacent the pin receiving receptacles and radially therewithin. A table has a lock secured to an undersurface thereof, such block supporting at least one pin extending outwardly and disposed having its axis parallel to the axis of the rod. Spring means are provided for engaging the pin within the pin-receiving receptacle, such that the table is disposed in any plane desired.

4 Claims, 7 Drawing Figures

STORABLE TABLE

BACKGROUND OF THE INVENTION

1. The Field of the Invention

This invention relates to stands, worktables, workstools, shelves, or the like which are used to support a variety of materials, or to provide a working surface, by attachment within apparatus to a supporting structure.

2. Description of the Prior Art

The prior art includes retractable shelves which are stored slightly below the uppermost surface of a table-like surface. Other schemes include shelves hingeably mounted in drop leaf fashion which pivot from the vertical position about an axis parallel to one inch of the table. Other refinements include horizontally extensible surfaces adapted with supporting legs and built in storage compartments. My U.S. Pat. No. 3,980,265 issued on Sept. 14, 1976 teaches a slideable mechanism supporting an L-shaped bracket depending downwardly therefrom. The lowermost leg of the bracket supports in turn, a table in pivotable fashion. Locking means are provided which permit such table to be stored in a vertical or in a horizontal position. Such locking means are limited to rotation of one ninety degree turn, compelling the user to elect to store the moveable table-like structure having its uppermost surface in a vertical plane or in a horizontal plane, but in an uppermost position. This limitation prevented the table from being rotated in any selected position, other than the two positions taught.

SUMMARY OF THE INVENTION

A shelf-like accessory for attachment to a supporting structure, such as an edge of a supporting table, which is stored when not in use, vertically along side and below one side of the table. Means are provided to extend the shelf, while lying in a vertical plane, along a track parallel to the side edge of the table, until the shelf is fully extended from beneath the table edge. When the shelf is so fully extended, a detent mechanism, having spring means attached thereto, permits rotation of the table into a horizontal position, or if desired, into the reverse vertical position, or if desired, into a reversed horizontal position, or, depending upon the construction employed, into any position at all. The spring means, when operated, disengages the detenting mechanism so as to permit the rotation of the tabletop. When the spring means are released, the detenting mechanism is engaged, causing the table to become locked in one of the aforesaid selected positions. When in the ultimate selected position, at which the shelf is to be used, the shelf is placed slightly forward of the front longitudinal edge of the table, and is maintained in a position somewhat lower than the surface of the table. If desired, the means to extend the shelf may be fastened to a vertical wall, such as the side wall of a bookcase, so that the tabletop, when disposed in a vertical position may have its opposed parallel surfaces reside parallel to the outmost surface of the bookcase wall. In this example, the tabletop, when in a use position, may be disposed outwardly from the front edges of the bookcase, in either of two horizontal or two vertical planes.

A primary object of the present invention is to provide an accessory shelf for use with a supporting structure having a table-like surface conveniently stored in a vertical plane.

Another object of the present invention is to provide a detenting means to maintain the shelf, when in a stored position, in a vertical plane and removeably locked therein.

Still another object of the present invention is to provide simply guidance means to permit the shelf easily withdrawn from its storage position.

Yet another object of the present invention is to provide spring detenting means to maintain the shelf in either of two horizontal positions or two vertical use positions when the shelf is fully withdrawn.

A further object of the present invention is to provide that the surface of the tabletop or shelf, when horizontal, is disposed below a part of the structure of the apparatus that is secured to the supporting structure.

Another object of the present invention is to provide a tabletop shelf-like structure which does not store horizontally below the structure supporting the tabletop, thus providing ready access to all portions of the supporting structure and associated devices, if any.

Still another object of the present invention is to provide a shelf-like surface which extends partially outwardly and beyond the width of the supporting structure to which it is mounted.

Yet another object of the present invention is to provide an accessory shelf, having at least one of its surfaces protected from accidental damage when it is in the vertical stored position.

A further object of the present invention is to provide an accessory shelf device which does not occupy a substantial volume when the shelf is in a stored position.

Another object of the present invention is to provide a convenient shelf which can be mounted on any or both sides of a supporting structure.

These objects as well as other objects, of this invention will become readily apparent after reading the following description of the accompanying drawings.

DESCRIPTION OF THE PREFERRED EMBODIMENT

Figure 1:
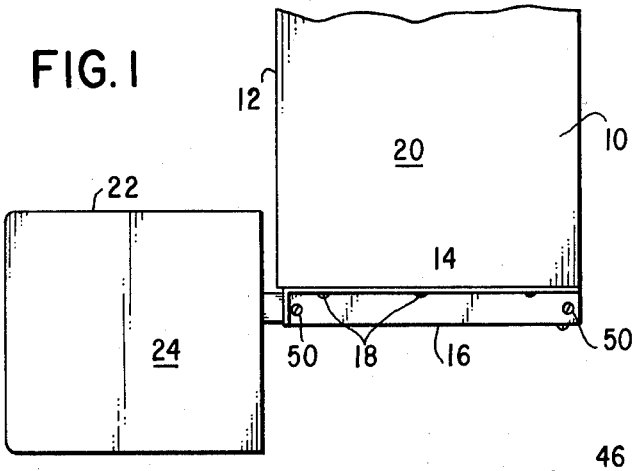
FIG. 1 is a plan view of a portion of a table-like supporting structure illustrating the accessory shelf locked in a horizontal extended position.

The structure and method of fabrication of the present invention is applicable to a retractable convenience shelf, which is stored in a vertical position, below and alongside a passageway disposed within a horizontal track. The track may be permanently affixed to any supporting structure, such as the edge of a table or a vertical wall. A sliding member is captured in the track and limited in its travels along the entire length of track by two pins, each which traverse a portion of the cavity in the track in which the slide travels. The pins are located near each free end of the track. The slide is T-shaped, as is the passageway within the track. A portion of the track emerges outwardly from a slot in the T-shaped passageway. A rectangular L-shaped bar-shaped member extends downwardly, in a vertical position, having one leg of the L-shaped member secured to the protruding portion of the sliding member. The other leg of the L-shaped member is fashioned so as to have therein four pin receiving receptacles, or holes. Such holes are disposed radially outwardly from a central hole, configured to have a right angle rod pass therethrough. In the preferred embodiment, the rod is rotatably and slideably affixed to the central hole. One end of the rod is fitted with nut, threadingly engaged thereon. Between this nut and the adjacent surface of the L-shaped member, a spiral wound spring resided about the exterior surface of the rod. The other end of the rod passes through a block, having a central threaded hole therein. Such central threaded hole engages external threads located at the other end of the rod. Another nut, locks the other end of the rod to the block. The block is fitted with four pins, such that the free ends of the pins are disposed outwardly from the surface of the block that is adjacent but opposite the surface of the L-shaped member having the pin receiving receptacles or holes therein. Attached to one edge of the block is a table-like surface, utilizing convenient screw-like means. The spring mechanism acts as a means to urge the pin receiving receptacles to receive, at all times, the pins that are secured to the table. When the spring is overcome, by a force on the table, causing the pins to be removed from the pin receiving receptacles, the table pivots about the longitudinal axis of the rod, such that the table can be stored in either of two vertical or two horizontal positions, permitting the pins to re-engage the pin receiving receptacles, on removing the force adapted engage the pins within the pin receiving receptacles. Thus, the table may be withdrawn in a vertical position, along a path parallel to the longitudinal axis of the passageway, such that the table is disposed outwardly from one of the edges of a table to which the track may be secured, or, from the edge of a vertical wall to which the track is attached. In such extended position, continuing to exert a force on the table, in the withdrawing direction, causes the spring means, normally biasing the pins into the pin receiving receptacles, to be overcome, allowing the table to be rotated into any of four preferred positions. Then, releasing the spring overcoming force, permits the table to be locked into one of such four positions, while in an extended use condition. Restoring the table to its stored position, requires a user to again overcome the spring bias means, so as to place the table into a vertical plane. Then, applying a force in a suitable direction, urges the sliding member along the length of the track, such that either of the two lateral surfaces of the table may be extended into an outward and vertical plane from the supporting surface.

DESCRIPTION OF AN ALTERNATE EMBODIMENT

The alternate embodiment employes the horizontal track member, the sliding member, the L-shaped member, the table member, the rod member, the spiral wound spring member, and a block member, all substantially equivalent to that described in the preferred embodiment thereof. However, in the alternate embodiment, the rod member is secured against rotation, by fixing one end to the lowermost regions of the L-shaped member. The block is not adapted with an internally threaded central hole, but is provided with a hole slideably and rotationally secures a portion of the rod therein. The spring is disposed on a portion of the rod, that is located adjacent to one of the lateral surfaces of the plate, and is secured therealong by the utilization of another nut, attached to the end of the rod. In this embodiment, the rod mechanism and the spiral spring, as well as the major portion of the rod, is disposed adjacent to one of the lateral surfaces of the plate. This is opposed to the preferred embodiment wherein the spring covered portion of the rod is disposed outwardly from the marginal edges of the tabletop. The application of forces are similar and the position that the table may achieve is similar to the same forces and positions achievable by the apparatus described in the preferred embodiment.

Now referring to the figures, and more particularly to the embodiment illustrated in FIG. 1 showing a fragmentary portion of a table 10, having marginal edges 12 and 14. Track 16 is shown secured to marginal edge 14, utilizing bolts 18 therefor. Top most surface 20, of table 10, resides in a horizontal plane. Tabletop 22, is shown extending outwardly from marginal edge 12, and is provided having uppermost surface 24, shown which resides parallel to surface 20.

Figure 2:
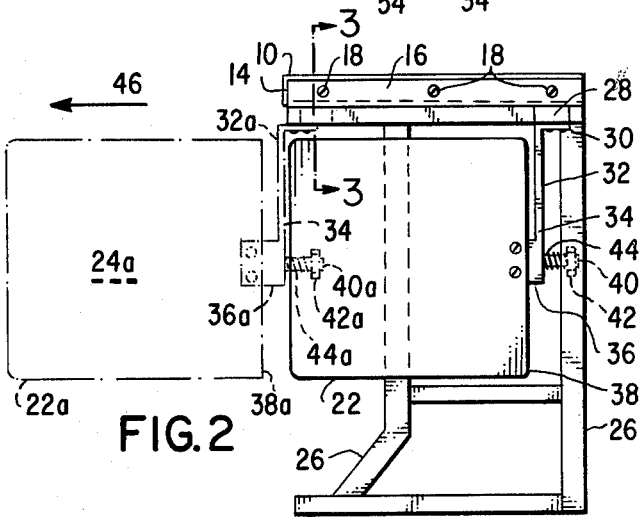
FIG. 2 is a side elevation view of the table illustrated in FIG. 1 showing the accessory shelf in a stored and in an extended or withdrawn position.

FIG. 2 illustrates supporting legs 26, of table 10, which in turn supports table structure 10. Depending downwardly from slide member 28, is leg 30, of L-shaped member 32. Screws 34 secure leg 30, to slide 28. Leg 34, of L-shaped member 32, is shown having protrusion portion 36 located adjacent edge 38 of table 22. Rod 40 is shown carrying nut 42 and spiral spring 44 thereon. When a force is exerted in the direction of arrow 46, table 22 and sliding member 28, move in the direction of arrow 46, such that table member 22 resides in the position shown by dotted lines **22*a*. If desired, edge 14** may be the vertical surface of a supporting structure, not shown.

Figure 3:
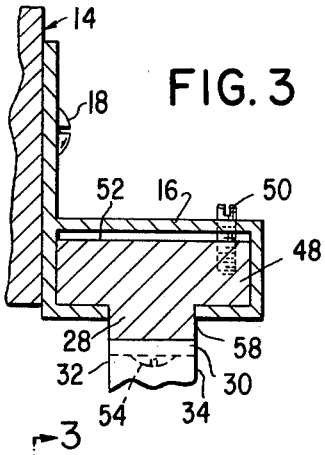
FIG. 3 is a side elevation cross sectional view, taken along lines 3—3, of FIG. 2 viewed in the direction of arrows 3—3, showing a fragmented portion of a table, track, internal slide and stop bolts, as well as a fragmented portion of a shelf supporting member.

FIG. 3 illustrates sliding block member 48, having protrusion portion 28 extending outwardly from slot 50 in track member 16. Screw 50 is threadingly engaged with track member 16, so as to prohibit sliding member 48 from traveling outwardly from the open ends of passageway 52. Screw 54 is shown securing leg 30 to protrusion portion 28, such that leg 34 of L-shaped bracket 32 depend downwardly from protrusion 58.

Figure 4:
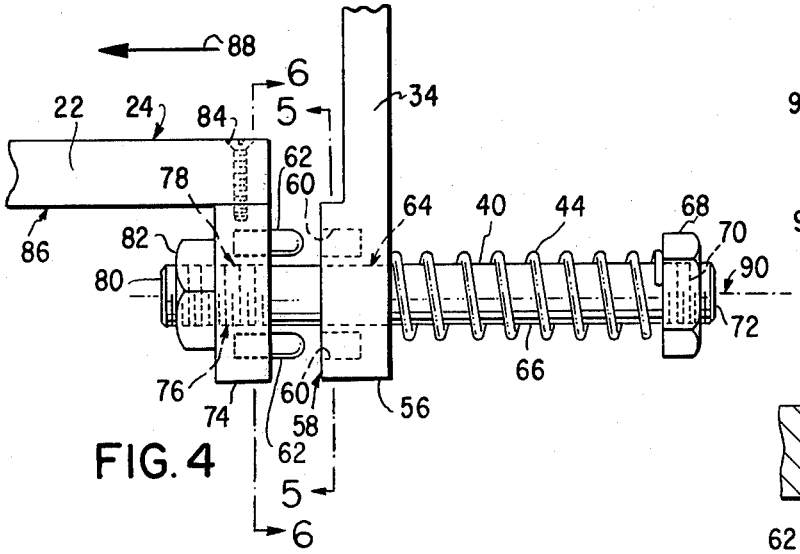
FIG. 4 is a side elevation view of a portion of the apparatus shown in FIG. 2.

FIG. 4 illustrates the lowermost region of leg 34, shown having thickened free end 56. Surface 58 is provided with pin receiving or receptacles 60 adapted to slidingly engage pins 62 therein. Rod 40 is slideably and rotationally engaged within hole 64, located near the end of leg 34. Spiral wound spring 44 is shown secured about portion 66 of rod 40. Nut 68 is engaged on external threads 70, at end 72, of rod 40. Pins 62 are press fit for not removeable engagement within block 74. Hole 76, in block 74 threadingly engages external threads 78, located at end 80, of rod 40. Nut 82 prevents further rotation of rod 40 in hole 76. Table 22 is secured by block 74, by flat head screws 84. Surface 24, of table 22, is shown in a horizontal plane. Surface 86, of table 22, disposed opposite the surface 24, is shown also in a horizontal position, but below surface 24. In the position shown, due to the partial compression of spring 44, by way of the application of forces in the direction of arrow 88, on table 22, the free ends of pins 62 are disengaged from pin receiving receptacles or holes 60, thereby permitting table 22 to be rotated in any position. When the force is relieved from table 22, spring 44, urges end 72 of rod 40, in the direction opposite arrow 88, causing the free ends of pins 62 to move towards surface 58. If the longitudinal axis of pin 62 are aligned with the longitudinal axes of pin receiving receptacles 60, table 22 will become engaged in a preferred position. If it is desired to reverse or alter the position of table 22, this can be done by the application of forces in the direction of arrow 88, accompanied by a rotational force, radially about the longitudinal axis 90 of rod 40.

Figure 5:
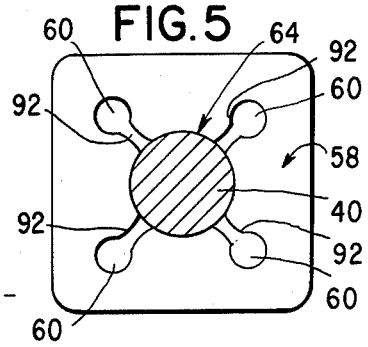
FIG. 5 is a side elevation cross sectional view, taken along lines 5—5, viewed in the direction of arrows 5—5, of the apparatus shown in FIG. 4.

FIG. 5 illustrates hole 64, in the protrusion portion of leg 34. Four pin receiving receptacles 60 are shown located at right angles to one another and disposed equally radially outwardly from the center of rod 40, shown centrally located within hole 60. Passageways 92 are provided for ease of molding, and serve no structural or functional purpose. For the design shown, namely, four pin receiving receptacles 60, table 22, and shown in FIG. 4, may reside in one of four positions. In two said positions are where surface 24, shown in FIG. 4, are vertically disposed, but having such surface stored outwardly or inwardly from longitudinal axis 90 of rod 40. Alternatively, surface 24 may be disposed upwardly or below the longitudinal axis 90, when table 22, not shown, is located in a horizontal plane.

Figure 6:
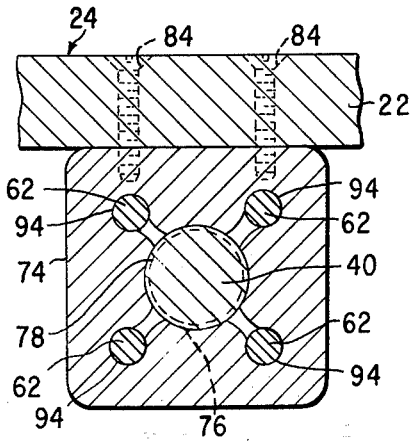
FIG. 6 is a side elevation cross sectional view, taken along lines 6—6, viewed in the direction of arrows 6—6, of a portion of the apparatus shown in FIG. 4.

FIG. 6 illustrates table 22, shown secured to block 74, utilizing screws 84 therefor. Pins 62 are shown embedded within pin receiving holes 94, by way of press fit. Threaded rod 40, is threadingly engaged to block 74, utilizing threads 78, located on the interior of hole 76. Thus, in aide of block 82, shown in FIG. 4, threaded rod 40 will not rotate relative to block 74.

Figure 7:
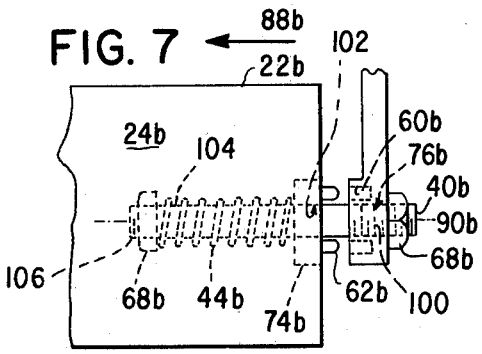
FIG. 7 is an alternate embodiment of the present invention, shown in side elevation view.

FIG. 7 illustrates the alternate embodiment of the apparatus shown in FIGS. 1–6. Such alternate embodiment utilizes a table **22*b* having an exposed lateral surface 24*b*. Threaded rod 40*b* is shown threadingly engaged to hole 76*b*, utilizing threads 100, located within the interior of hole 76*b*. Nut 68*b* secures rod 40*b* against further rotation, about longitudinal axis 90*b*. Dotted lines 74*b* depict a block, having a centrally located hole 102 therein. Such hole permits the sliding and rotational engagement of a portion of rod 40*b* to block 74*b*. Spring 44*b*, shown in dotted lines, extends spirally around about portion 104 of threaded rod 40*b*. Nut 68*b* is threadingly engaged to end 106 of rod 40*b*. As can be seen, when a force is applied in the direction of arrow 88*b* spring 44*b*, as shown, become partially compressed, thereby permitting block 74*b* to slide along the surface of rod 40*b* and thus disengage pins 62*b* from pin receiving receptacles 60*b*. On releasing such applied force to table 22*b*, spring 44*b* exerts a force, in a direction opposite to arrow 88*b*, permitting the free ends of pins 62*b*, to engage pin receiving receptacles or holes 60*b*. In short, the difference between the alternate embodiment shown in FIG. 7, and the preferred embodiment indicated in FIGS. 1–6, is that the bulk of rod 40, as well as spring 44, as shown in FIGS. 1–6, are disposed adjacent to a lateral surface of table 22*b***.

One of the advantages of the present invention is an accessory shelf for use with a supporting structure having a table-like surface conveniently stored in a vertical plane.

Another advantage of the present invention is a detenting means to maintain the shelf, when in a stored position, in a vertical plane and removeably locked therein.

Still another advantage of the present invention is simply guidance means to permit the shelf easily withdrawn from its storage position.

Yet another advantage of the present invention is a spring detenting means to maintain the shelf in either of two horizontal positions or two vertical use positions when the shelf is fully withdrawn.

A further advantage of the present invention is that the surface of a tabletop or shelf, when horizontal, is disposed below a part of the structure of the apparatus that is secured to the supporting structure.

Another advantage of the present invention is a tabletop shelf-like structure which does not store horizontally below the structure supporting the tabletop, thus providing ready access to all portions of the supporting structure and associated devices, if any.

Still another advantage of the present invention is a shelf-like surface which extends partially outwardly and beyond the width of the supporting structure to which it is mounted.

Yet another advantage of the present invention is an accessory shelf, having at least one of its surfaces protected from accidental damage when it is in the vertical stored position.

A further advantage of the present invention is an accessory shelf device which does not occupy a substantial volume when the shelf is in a stored position.

Another advantage of the present invention is a convenient shelf which can be mounted on any or both sides of a supporting structure.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A storable table comprising a longitudinal track fastened horizontally to a supporting vertical structure, a longitudinal slot extending the entire length of the lowermost surface of a cavity in said track, said cavity extending the length of said track, a slideable support member within said cavity substantially shorter than the entire length of said track, and L-shaped bracket having a leg depending vertically downwards from the lowermost surface of said slideable support member, a shelf member, detenting means to removeably detentingly engage said shelf member to said L-shaped bracket in a selected one of a plurality of positions wherein a lateral surface of said shelf member is disposed in one of a plurality of planes, biasing means for urgingly and disengageably engaging a portion of said detenting means in any of said plurality of postions including detenting means whereby said lateral surface of said shelf is free to rotate in any plane when said biasing means are overcome wherein said detenting means comprises a plurality of pins, said pins being secured to said shelf in uniform spaced apart relationship about a bolt circle, a plurality of pin receiving holes, said pin receiving holes located in said leg and spaced apart uniformly about another bolt circle, said bolt circle and said another bolt circle having the same diameter, wherein said biasing means comprise a rod, a helical spring, said helical spring being disposed about a first portion of said rod, a second portion of said rod being disposed engaged with said leg, a block, said block being disposed secured to said shelf, a third portion of said rod being disposed secured to said block whereby said spring urges an adjacent surface of said block towards an adjacent surface of said leg, wherein said second portion of said rod is slideably and rotationally engaged with said leg, wherein said plurality of pins includes four pins, each of said pins being disposed defining the four corners of a square and wherein said four pins engage all of said pin receiving holes when said block is detentingly engaged with said adjacent surface of said leg.

2. The apparatus as claimed in claim 1 wherein said second portion of said rod is threadingly enmgaged to said leg.

3. The apparatus as claimed in claim 1 further comprising means to limit the travel of said slideably support member within said cavity.

4. The apparatus as claimed in claim 1, wherein said means to limit comprise a bolt, said bolt being threadingly engaged to said track, said bolt having a free end, said free end being disposed within said cavity.

* * * * *